US006713734B2

(12) United States Patent
Suzuki

(10) Patent No.: US 6,713,734 B2
(45) Date of Patent: Mar. 30, 2004

(54) IMAGE HEATING APPARATUS FOR HEATING IMAGE FORMED ON RECORDING MATERIAL

(75) Inventor: Hitoshi Suzuki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/021,089

(22) Filed: Dec. 19, 2001

(65) Prior Publication Data

US 2002/0079312 A1 Jun. 27, 2002

(30) Foreign Application Priority Data

Dec. 22, 2000 (JP) ..... 2000-390432

(51) Int. Cl.[7] ..... H05B 6/14; G03G 15/20

(52) U.S. Cl. ..... 219/619; 219/670; 219/676; 399/328; 399/330; 336/210

(58) Field of Search ..... 219/619, 670, 219/676; 399/328, 330, 335, 336, 342; 336/210, 234

(56) References Cited

U.S. PATENT DOCUMENTS 4,518,942 A * 5/1985 Geschka ..... 336/210
4,832,763 A * 5/1989 Rauch et al. ..... 219/670
5,393,959 A * 2/1995 Kitano et al. ..... 219/619
5,464,964 A 11/1995 Okuda et al. ..... 219/497
5,534,987 A 7/1996 Ohtsuka et al. ..... 355/285
5,552,582 A 9/1996 Abe et al. ..... 219/619
5,713,069 A * 1/1998 Kato ..... 399/330
5,747,774 A 5/1998 Suzuki et al. ..... 219/216
5,752,150 A 5/1998 Kato et al. ..... 399/330
5,994,671 A 11/1999 Suzuki et al. ..... 219/216
6,031,215 A * 2/2000 Nanataki et al. ..... 219/619
6,246,036 B1 * 6/2001 Tsujimoto et al. ..... 219/619
6,336,027 B1 * 1/2002 Sakai et al. ..... 399/328

FOREIGN PATENT DOCUMENTS

EP 0 556 939 * 8/1993 ..... 336/234

* cited by examiner

*Primary Examiner*—Philip H. Leung
(74) *Attorney, Agent, or Firm*—Fitzpatrick, Cella, Harper & Scinto

(57) ABSTRACT

An image heating apparatus has an excitation coil for generating a magnetic field and a heating member for dissipating heat by an eddy current induced in the heating member by that magnetic field. A core is provided for guiding the magnetic field and the core includes a sheet-shaped multi-layered magnetic member and is held by a holder which includes a cramping portion to cramp the core with the cramping portion.

9 Claims, 5 Drawing Sheets

IMAGE HEATING APPARATUS FOR HEATING IMAGE FORMED ON RECORDING MATERIAL

BACKGROUND OF THE INVENTION

1. Field of the Invention

This invention relates to a heating apparatus of the induction heating type for heating an image formed on a recording material.

2. Related Background Art

A heating apparatus of the electromagnetic induction heating type causes a magnetic field to act on a stationary or movable electrically conductive member (an electromagnetic induction heat generating member, an induction magnetic member or a magnetic field absorbing electrically conductive member) and effects the heating of a material to be heated by heat generation by an eddy current generated in the electrically conductive member, and is effective, for example, as an image heating and fixing apparatus for heating a recording material (a material to be heated) bearing an unfixed toner image thereon in an image forming apparatus of the electrophotographic type, the electrostatic recording type, the magnetic recording type or like type to thereby fix the unfixed toner image as a permanently secured image.

Generally, in the image heating and fixing apparatus, a magnetic field is caused to act on the stationary or movable electrically conductive member and by the heat generation by an eddy current generated in the electrically conductive member, a recording material which is a material to be heated conveyed in direct or indirect contact with the electrically conductive member is heated and therefore, magnetic field generating means comprising a coil and a core is constructed in a direction intersecting with the conveying direction of the recording material.

It is usual to use as the core a ferrite core often used in a transformer or a choke coil.

The ferrite core which is a sintered article is difficult to mold with a small thickness and usually, a thin ferrite core has a thickness of the order of 3 to 5 mm. Since it has a certain degree of thickness, a complicated mechanism is usually not required as a mechanism for holding this core. However, when an electrical characteristic is taken into account, the ferrite core has the disadvantage in which it must be used with a minimum thickness which is conversely determined in molding (in spite of having a sufficient surplus in an effective cross-sectional area relative to necessary magnetic flux density). That is, the thickness of the core has been greater than the effective cross-sectional area considered from the required magnetic flux density, and has increased unnecessary space and also has increased the material used to thereby increase the cost.

Also, the ferrite core is a sintered article as previously described and is therefore weak to the shock of a collision, a fall or the like and may be cracked or chipped. If it is used while being cracked or chipped, the deterioration of its characteristic or heat generation or the like will be caused and it will become necessary to take care in handling it in the manufacturing process thereof.

SUMMARY OF THE INVENTION

The present invention has been made in view of the above-noted problem and an object thereof is to provide a compact image heating apparatus of the induction heating type.

Another object of the present invention is to provide an image heating apparatus of the induction heating type which is high in the strength of a core.

Still another object of the present invention is to provide an image heating apparatus of the induction heating type in which the heat generation of a coil can be suppressed.

Yet still another object of the present invention is to provide an image heating apparatus of the induction heating type comprising:

a heating member;

an excitation coil for generating a magnetic field to induce an eddy current in the heating member; and a core disposed in a magnetic circuit generated by the coil, the core being of a construction in which a plurality of sheet-shaped magnetic members are piled up.

Further objects of the present invention will become apparent from the following detailed description when read with reference to the accompanying drawings.

BRIEF DESCRIPTION OF THE DRAWINGS

DESCRIPTION OF THE PREFERRED EMBODIMENTS (1) Example of the Image Forming Apparatus FIG. 1 is a typical view schematically showing the construction of an image forming apparatus in an embodiment of the present invention. The image forming apparatus in the present embodiment is a printer or a copier using the transfer type electrophotographic process.

Figure 1:
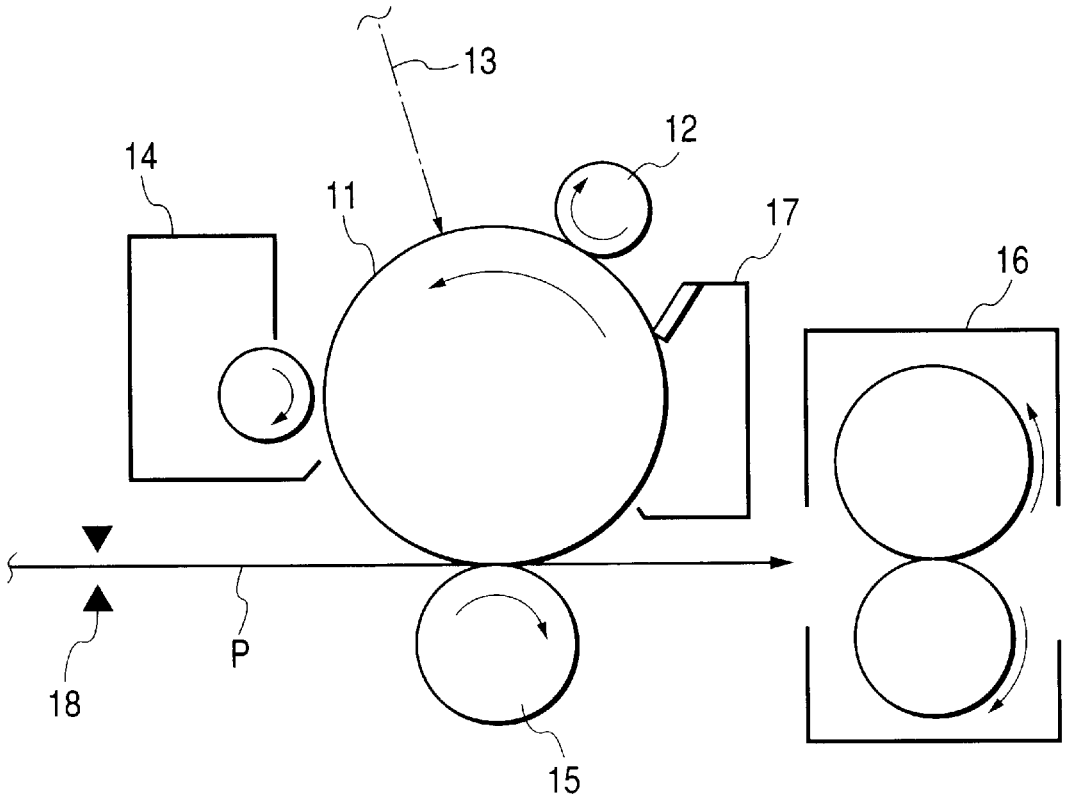
FIG. 1 is a typical view schematically showing the construction of an image forming apparatus in an embodiment of the present invention.

The reference numeral 11 designates a photosensitive drum as an image bearing body comprising a cylinder-shaped base body of aluminum, nickel or the like and a photosensitive material such as OPC, amorphous Se or amorphous Si formed thereon. The photosensitive drum 11 is rotatively driven at a predetermined peripheral speed (process speed) in the backward direction (counterclockwise rotation) of rotation as arrowed.

In the charging step, the rotary photosensitive drum 11 first has its surface uniformly charged to a predetermined polarity and potential by a charging roller 12 as a charging device having a predetermined charging bias voltage applied thereto.

Next, in the exposing step, the charged surface of the rotary photosensitive drum 11 is subjected to scanning exposure by a laser beam 13 ON/OFF-controlled in conformity with image information by image exposing means, not shown, for example, a laser beam scanner. Thereby, an electrostatic latent image corresponding to the scanning exposure pattern is formed on the surface of the rotary photosensitive drum 11.

In the developing step, the electrostatic latent image is developed as a toner image by a developing device 14. As the developing method, use is made of the toner projection developing method (jumping development method), the two-component developing method, the FEED developing method or the like, and image exposure and reversal development are often used in combination.

In the transferring step, the toner image on the surface of the rotary photosensitive drum 11 is transferred onto a recording material P in the transferring nip part which is the portion of contact between a transferring roller 15 as a transferring apparatus and the photosensitive drum 11.

The transferring roller 15 is brought into contact with the photosensitive drum 11 with a predetermined pressure force, and is rotated in the forward direction (clockwise rotation) of rotation of the photosensitive drum 11 substantially at the same peripheral speed as the peripheral speed of the photosensitive drum 11. Also, a predetermined transferring bias voltage is applied to the transferring roller 15. The recording material P is fed from a sheet feeding mechanism side, not shown, to the transferring nip part at predetermined control timing, and is nipped and conveyed by the predetermined pressure force of the transferring nip part formed by the photosensitive drum 11 and the transferring roller 15.

Here, the leading end of the recording material conveyed from the sheet feeding mechanism side to the transferring nip part is detected and the timing thereof is adjusted so that the image forming position of the toner image on the photosensitive drum 11 and the writing start position on the leading end of the recording material may coincide with each other (registration).

In the fixing step, the recording material P to which the toner image has been transferred in the transferring nip part is separated from the surface of the rotary photosensitive drum 11 and is conveyed to an image heating and fixing apparatus (image heating apparatus) 16, where the toner image thereon is fixed as a permanent image.

On the other hand, in the cleaning step, any untransferred residual toner residual on the photosensitive drum 11 is removed from the surface of the photosensitive drum 11 by a cleaning device 17. The photosensitive drum 11 is repetitively used for image formation.

(2) Image Heating and Fixing Apparatus 16

A) General Schematic Construction of the Apparatus

Figure 2A:
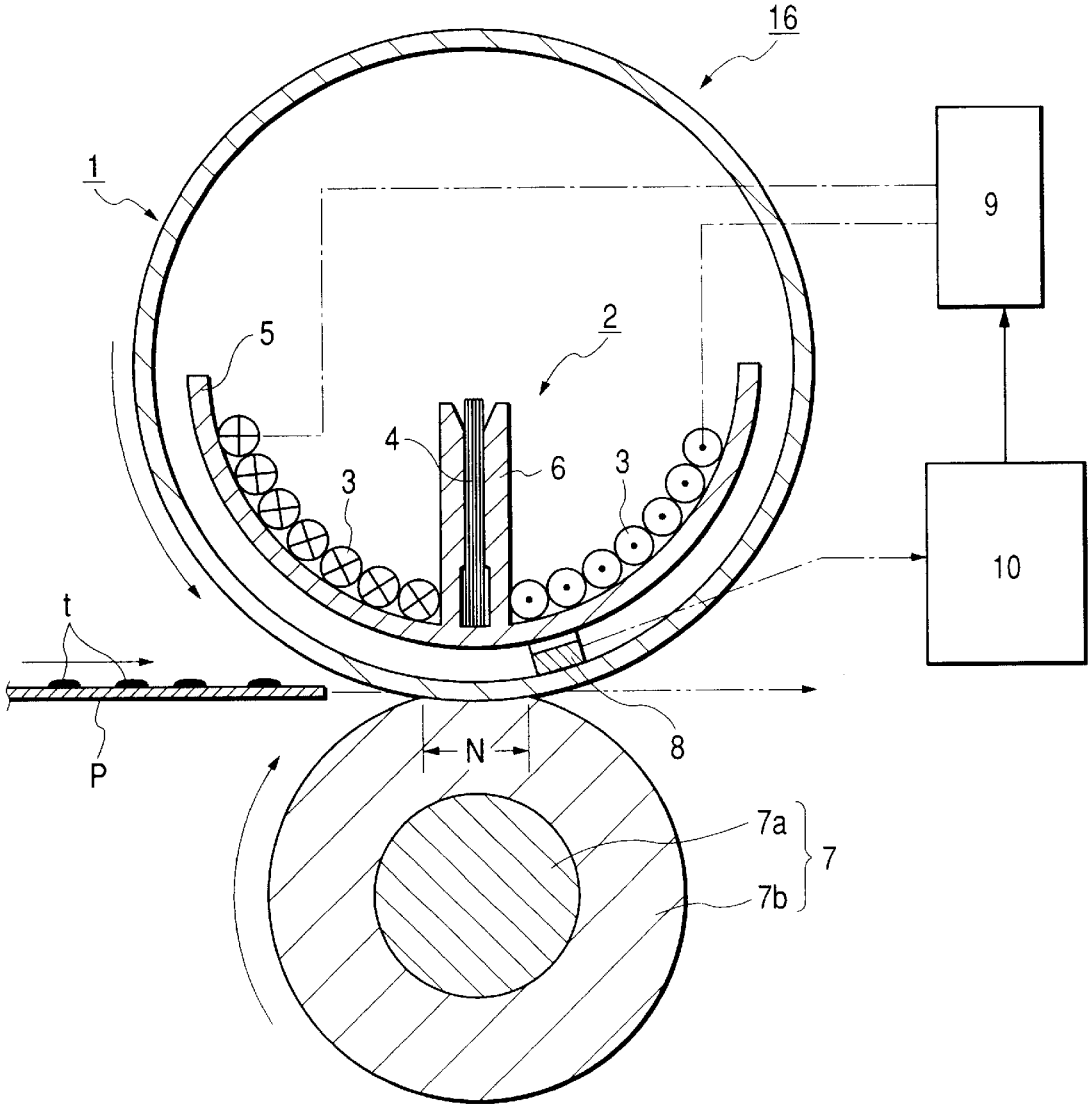
FIG. 2A is a transverse cross-sectional typical view of a heating apparatus (image heating and fixing apparatus) in the embodiment.

FIG. 2A is an enlarged transverse cross-sectional typical view of the image heating and fixing apparatus 16. This image heating and fixing apparatus 16 is a heating apparatus (image heating apparatus) of the electromagnetic induction heating type according to the present invention.

The reference numeral 1 designates a cylindrical fixing roller (heating member) which is an electrically conducting member generating heat by an eddy current generated by the action of a magnetic field. Specifically, it is formed of an electrically conductive material having a magnetic characteristic, such as iron, nickel or stainless steel. This fixing roller 1 has its opposite end portions rotatably supported and disposed between the chassis side plates (not shown) of the apparatus through bearings (not shown).

The reference numeral 2 denotes a coil assembly disposed in the above-described cylindrical fixing roller 1 and generating a magnetic field to cause the fixing roller 1 to electromagnetically induction-heat. This coil assembly 2 will be described later in detail.

The reference numeral 7 designates a pressure roller comprising a mandrel 7*a* and a heat-resistant elastic material layer 7*b* covering the mandrel in a roller shape concentric therewith. This pressure roller 7 is disposed in parallel to the fixing roller 1 under the fixing roller 1 and has the opposite end portions of its mandrel 7*a* rotatably supported and disposed between the chassis side plates (not shown) of the apparatus through bearings (not shown), and also is brought into pressure contact with the underside of the fixing roller 1 with a predetermined pressure force by a biasing member (not shown) against the elasticity of the elastic material layer 7*b* to thereby form a fixing nip part N having a predetermined width.

A pair of rollers formed by the fixing roller 1 and the pressure roller 7 are rotatively driven at a predetermined rotational speed in the directions of arrows by a driving system (not shown). As previously described, the recording material P to which the unfixed toner image t has been transferred in the transferring nip part is introduced into the above-described fixing nip part N and is nipped and conveyed thereby, and in the process of being nipped and conveyed, the unfixed toner image t is heated and fixed on the surface of the recording material P by the heat and nip pressure of the electromagnetically induction-heated fixing roller 1. The recording material passed through the fixing nip part N is separated from the surface of the roller 1 and is conveyed.

B) Coil Assembly 2

The coil assembly 2 disposed in the cylindrical fixing roller 1 is comprised of an excitation coil 3 and a magnetic core 4 constituting magnetic field generating means, and a holder 5 holding the magnetic field generating means 3 and 4.

The holder 5 is of a trough shape having a substantially semicircular transverse cross-section, and is a heat-resistant, adiabatic and rigid member formed, for example, of a liquid crystal polymer, phenol resin or the like.

The excitation coil 3 is comprised of a litz wire or the like wound into a boat shape substantially corresponding to the shape of the inner surface of the holder 5, and is fitted and held inside the holder 5. It is wound in a direction intersecting with the conveying direction of the recording material P which is a material to be heated.

Figure 2B:
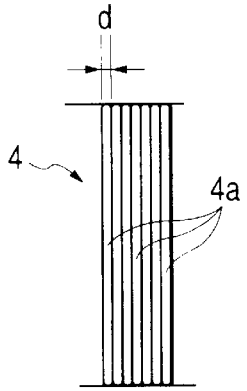
FIG. 2B is an enlarged typical view of a portion of a laminated core.

The magnetic core 4, as shown in the enlarged fragmentary typical view of FIG. 2B, is a laminated core comprising a lamination of two or more magnetic material sheets 4*a* each having a thickness of 10 to 300 $\mu$m and a length substantially equal to the longitudinal length of the holder 5. This laminated core 4 is held by being inserted into a cramp-shaped holding portion 6 upwardly provided in the central portion of the inner side of the holder 5. The laminated core 4 is constructed in the direction intersecting with the conveying direction of the recording material P which is the material to be heated. Also, the holder 5 holds the core 2 so that as shown in FIG. 2A, the plane of the sheets 4*a* may be perpendicular to the fixing roller 1.

That is, to constitute the laminated core 4 by the lamination of the magnetic material sheets 4*a*, the holding of it by the holder 5 is indispensable. The holder 5, as described above, is provided with the cramp-shaped holding portion 6 as a mechanism for cramping and holding down the laminated core 4, and this holds the laminated core 4. By this mechanism 6 being provided on the holder 5, the laminated core 4 can be reliably fixed by a simple construction.

The cramp mechanism 6 for cramping and holding down the laminated core 4 is formed of a heat-resistant material such as resin or glass. In the present embodiment, it is provided by being molded integrally with and out of the same material as the holder 5. A cramp mechanism formed of the same material as the holder 5 or a material discrete from the holder 5 can also be provided by being attached later to the holder 5 or being molded integrally with the holder 5.

The above-described coil assembly 2 is inserted in the cylindrical fixing roller 1 with its arcuate outer surface facing downwardly, and is disposed with the opposite end portions of the holder 5 fixed to and held by an immovable holding member (not shown).

C) Temperature Control of the Fixing Roller 1

An alternating current is applied from an excitation circuit 9 to the excitation coil 3 of the magnetic field generating means 3 and 4, whereby a magnetic field is generated, and the thus generated magnetic field passes through the fixing roller 1 formed of an electrically conductive material, whereby the electrically conductive layer of the fixing roller 1 electromagnetically induction-heats.

The fixing roller 1 and the pressure roller 7 are rotatively driven and the alternating current is applied to the excitation coil 3 to thereby cause the fixing roller 1 to electromagnetically induction-heat. The temperature state of the fixing roller 1 is detected by a thermistor 8 as a temperature detecting element, and the detected temperature information is inputted to a control circuit 10. The control circuit 10 controls the application of the alternating current from the excitation circuit 9 to the excitation coil 3 so that the temperature of the fixing roller 1 (the temperature of the fixing nip part N) may be controlled and maintained at a predetermined fixing temperature.

As previously described, the recording material P to which the unfixed toner image t has been transferred in the transferring nip part is introduced to and nipped and conveyed by the fixing nip part N, and in the process of being nipped and conveyed, the unfixed toner image t is heated and fixed on the surface of the recording material P by the heat and nip pressure of the electromagnetically induction-heated fixing roller 1.

In the present embodiment, the thermistor 8 is fixedly disposed on the underside portion of the holder 5 and is brought into contact with the inner surface of the rotated fixing roller 1. The construction of the temperature detecting means for the fixing roller 1 may be arbitrary.

D) Another Example of the Laminated Core Holding Structure

Figure 3:
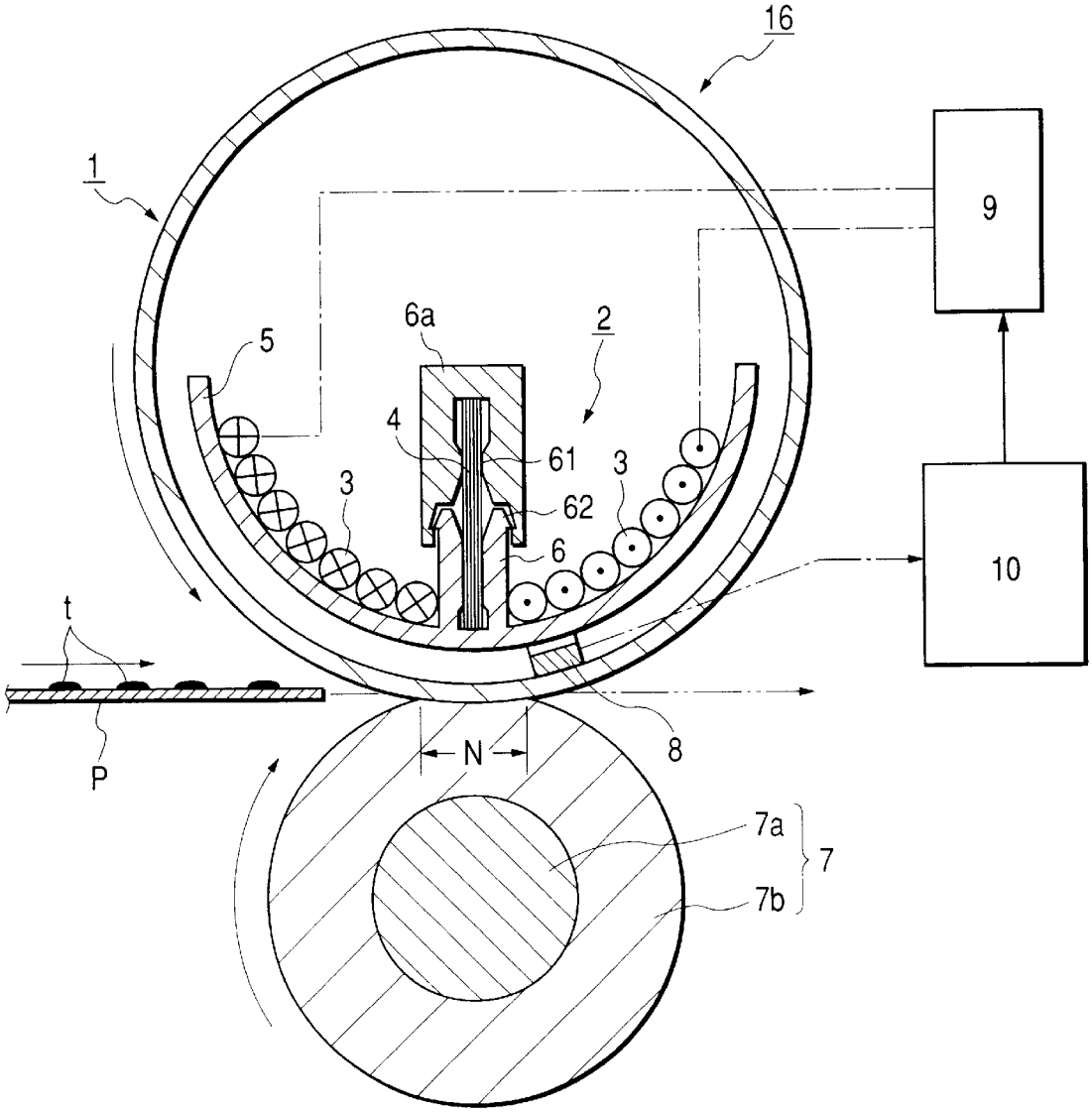
FIG. 3 is a transverse cross-sectional typical view of a heating apparatus (image heating and fixing apparatus) in which the construction of a laminated core holding mechanism is changed.

FIG. 3 shows another example of the laminated core holding structure. The reference character 6*a* designates a laminated core holding member discrete from the holder 5, and it is formed of a heat-resistant material such as resin or glass. This holding member 6*a* is provided with a mechanism portion (cramp portion) 61 for cramping and holding down with an elastic force the laminated core 4, and holds the laminated core 4. With the laminated core 4 remaining held by the holding member 6*a*, the laminated core 4 is inserted into the cramp-shaped holding portion 6 on the holder 5 side to thereby provide means for generating a magnetic field. The other apparatus construction than what is described above is similar to that of the apparatus of FIGS. 2A and 2B and therefore need not be described again.

This example is great in the degree of freedom of the design of shape and strength because the laminated core holding member 6*a* is independent of the holder 5.

Also, to use it as the coil assembly 2, it is more effective to provide a fitting portion 62 on the laminated core holding member 6*a* and the cramp-shaped holding portion 6 on the holder 5 side.

Consequently, in order to hold the laminated core 4, provision is made of the laminated core holding member 6*a* discrete from the holder 6 and it is used with the holder 6, whereby the laminated core can be reliably fixed by a simple construction.

E) About the Laminated Core 4

(1) The laminated core 4 is constituted by two or more sheets 4*a*. When it is to be assembled as the coil assembly 2, the laminated core 4, which is constituted by a plurality of sheets 4*a*, is liable to come asunder. This poses a problem in the manufacture or the use of it and therefore, it is desired for the laminated core 4 to be secured. However, when it is to be disposed inside the fixing roller 1, it is necessary from the influence of the excitation coil 3 to select, for example, an adhesive agent of silicon origin or resin origin or the like in conformity with the situation, such as adopting a heat-resistant adhesive agent.

Consequently, the laminated core 4 constituted by the sheets 4*a* is secured by an adhesive agent selected as to its quality, whereby the coil assembly 2 can be constructed by an easy method.

(2) The excitation coil 3 and the fixing roller 1 and the laminated core 4 may sometimes differ in potential (high voltage) depending on construction. Therefore, from the viewpoint of safety, it is desirable that the holder 5 and the laminated core holding member 6*a* become insulating members and can be separated from each other relative to the portions differing in potential by a prescribed distance.

In the present embodiment, the holder 5 and the laminated core holding member 6*a* secure a thickness of 0.4 mm or greater in all regions thereof facing the members differing in potential.

Also, as the material of the holder 5 and the laminated core holding member 6*a*, use is made of a material admitted by UL or in accordance with Japanese Electric Appliance and Material Control Law.

By the above measure, it becomes possible to substitute the distance along the surface as a condition for the necessary spatial distance by the regulations inside and outside the country, and the limitation in design is alleviated.

Consequently, from the way of view about safety regulations, between the members 5 and 6*a* differing in potential, a thickness of 0.4 mm or greater can be secured for the holder 5 and the laminated core holding member 6*a* to thereby provide insulating members, and a safe distance can be kept.

(3) When the sheets 4*a* are laminated as the laminated core 4 and used, as the effect by the laminated core 4 formed so as to assume the same cross-sectional area as a conventional ferrite core in which the thickness of a sheet is 3 to 5 mm, mention may be made of the fact that the influence by the epidermal effect of the core at a high frequency (20 kHz or higher) becomes small.

To form the sheet 4*a*, it is necessary to use a particular metallic material, and a sheet formed of an amorphous alloy which is composed chiefly of a ferromagnetic material such as Fe, Ni or Co and is non-crystalline is effective. The amorphous alloy is characterized in that it is small in core loss and great in magnetic flux density, is excellent in temperature characteristic and is high in Curie point and therefore, can be said to be a material effective under a high environmental temperature by the heating apparatus.

Consequently, as compared with known art, the core 4 in the magnetic field generating means can be formed by laminating the sheets of the amorphous alloy to thereby increase the turn width of the excitation coil 3 in the fixing roller 1, and decrease the self-heating of the excitation coil 3 and increase the opposed area of the excitation coil 3 to the fixing roller 1 and uniformize the heat by the self-heating of the excitation coil 3 as well as the heat of the fixing roller 1, and the cross-sectional area of the core can be made small to thereby reduce the cost and increase the effective space in the fixing roller 1 and thus, a countermeasure for the excessive temperature rise of the fixing roller 1 and the excitation coil 3 can be carried out by simple means.

(4) As in item (3) above, a core constituted by a silicon steel sheet is effective as the sheet material. The silicon steel sheet is characterized by great magnetic flux density, ease of working, mechanical strength and advantage in cost and therefore, as in item (3) above, it can be said to be a material effective under the high environmental temperature by the heating apparatus. Mention may also be made of the advantages that the ease of working leads to the possibility of effecting the integral molding by punching and that highly accurate molding can be effected and therefore a holder 5 of optimum dimensions can be realized.

Consequently, as compared with known art, the core 4 in the magnetic field generating means 3 and 4 can be formed by laminating silicon steel plates to thereby increase the opposed area of the excitation coil 3 to the fixing roller 1 and uniformize the heat by the self-heating of the excitation coil 3 as well as the heat of the fixing roller 1, and the reduction in cost by the use of an inexpensive material can be realized and the deformation rate by the heat is low and therefore designing becomes easy and thus, a countermeasure for the excessive temperature rise of the fixing roller 1 and the excitation coil 3 can be carried out by simple means.

(5) As the thickness d (FIG. 2B) of the sheets 4*a* constituting the laminated core 4 becomes smaller, the influence of the epidermal effect becomes smaller and the loss by the eddy current in the core decreases. In the heretofore used ferrite, as described in the foregoing items (3) and (4), it is difficult from the problem in manufacture to make the thickness thereof small. To make the thickness small, the amorphous metal and the silicon steel sheet described in items (3) and (4) are effective, and it is effective to laminate a plurality of sheets 4*a* of these materials to thereby form the laminated core 4.

The capability of forming the laminated core 4 by the sheets 4*a* for a necessary core cross-sectional area disperses the magnetic flux in the core to each of the sheets 4*a* and reduce the influence of the epidermal effect and also decrease the loss of the eddy current. Considering from the influence of the epidermal effect, it is desirable to use sheets 4*a* each having a thickness of 10 $\mu$m or greater and 300 $\mu$m or less.

Consequently, as compared with the known art, a core necessary as means for generating a magnetic field is formed as a laminated core 4 by a plurality of sheets 4*a* and useless heat is decreased, whereby useless heat transmitted from the laminated core 4 to the excitation coil 3 can be decreased and the electric current supplied to the excitation coil 3 can be decreased and thus, a countermeasure for the excessive temperature rise of the fixing roller 1 and the excitation coil 3 can be carried out by simple means.

(3) Others

1) While the above embodiment has been described with respect to a case where the coil assembly 2 including the magnetic field generating means 3 and 4 is disposed in the fixing roller 1, a similar effect will also be obtained in a case where the coil assembly 2 is disposed outside the fixing roller 1 and induction heating is effected from the outside of the fixing roller.

Also, while in the above-described embodiment, the length of the sheets 4*a* is substantially equal to the length of the holder 5 in the longitudinal direction thereof (the longitudinal direction of the fixing roller 1), this is not restrictive. There may be adopted a construction in which sheets having a small length are arranged in the longitudinal direction.

2) Also, while in the embodiment, the metallic fixing roller 1 is described as an electromagnetically induction-heating electrically conductive member, a similar effect will also be obtained in a heating apparatus comprised of metallic film having a similar magnetic characteristic.

Figure 4:
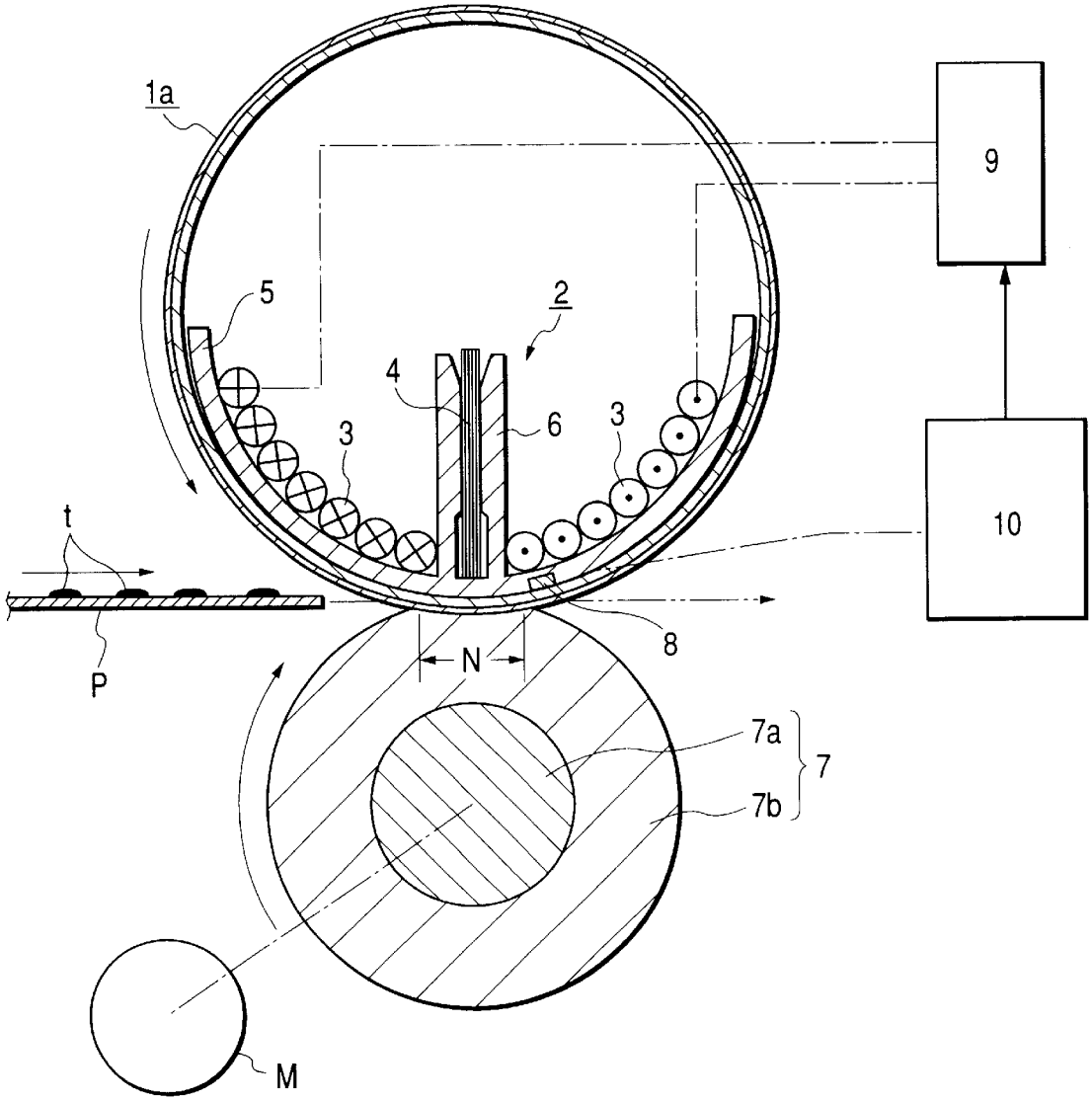
FIG. 4 is a transverse cross-sectional typical view of a heating apparatus (image heating and fixing apparatus) of another construction.

FIG. 4 shows an example of that apparatus. The reference character 1*a* designates cylindrical flexible metallic film or compound layer film including a metal layer, and as in the apparatus of FIGS. 2A and 2B, it is loosely fitted on a stationary coil assembly 2 including magnetic field generating means 3 and 4. A pressure roller 7 is brought into pressure contact with the underside of the coil assembly 2 with a predetermined pressure force with the film 1*a* interposed therebetween to thereby form a fixing nip part N having a predetermined width.

The pressure roller 7 is rotatively driven in the direction of arrow by a driving system M. The film 1*a* is driven thereby to rotate in the direction of arrow around the coil assembly 2 (a pressure roller driving system). An alternating current is applied to the excitation coil 3, whereby the film 1*a* is caused to electromagnetically induction-heat. The temperature state of the fixing nip part N is detected by a thermistor 8 as a temperature detecting element, and the detected temperature information is inputted to a control circuit 10. The control circuit 10 controls the application of the alternating current from an excitation circuit 9 to the excitation coil 3 so that the temperature of the fixing nip part N may be controlled and maintained at a predetermined fixing temperature.

As previous described, the recording material P to which the unfixed toner image t has been transferred in the transferring nip part is introduced to the fixing nip part N and nipped and conveyed thereby, and in the process of being nipped and conveyed, the unfixed toner image t is heated and fixed on the surface of the recording material P by the heat and nip pressure of the electromagnetically induction-heated film 1*a*.

Figure 5:
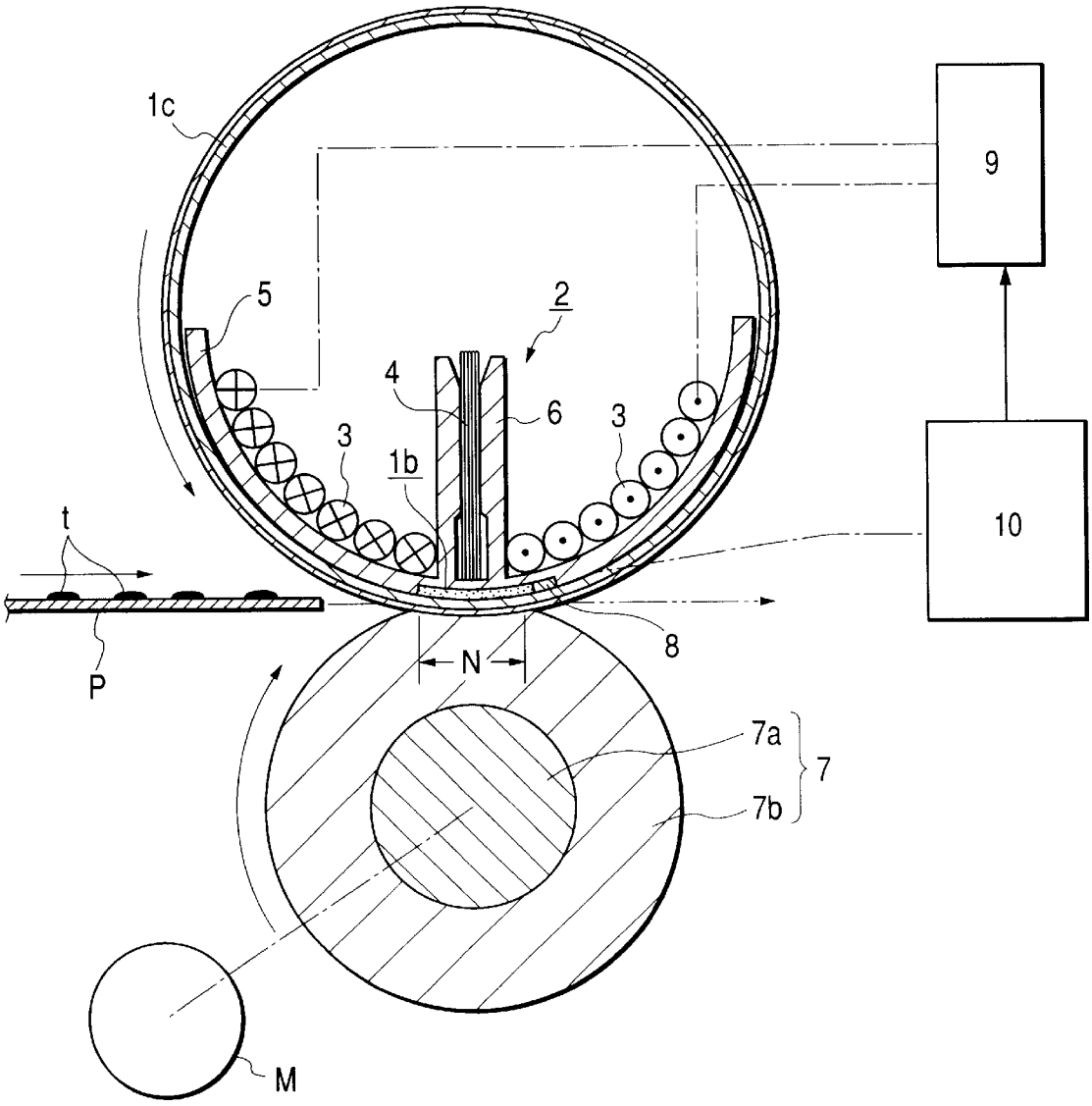
FIG. 5 is a transverse cross-sectional typical view of a heating apparatus (image heating and fixing apparatus) of another construction.

3) The electrically conductive member caused to electromagnetically induction-heat can also be made into a stationary member. FIG. 5 shows an example of that apparatus. The reference character 1*b* denotes an electrically conductive member which electromagnetically induction-heats. This electrically conductive member 1*b*, as in the apparatus of FIGS. 2A and 2B, is fixedly disposed on the central portion of the underside of a stationary coil assembly 2 including magnetic field generating means 3 and 4. The reference character 1*c* designates cylindrical flexible single-layer or compound-layer heat-resistant film loosely fitted on the stationary coil assembly 2 including the magnetic field generating means 3 and 4 and the electrically conductive member 1*b*. A pressure roller 7 is brought into pressure contact with the electrically conductive member 1*b* on the underside of the coil assembly 2 with a predetermined pressure force with the film 1*c* interposed therebetween to thereby form a fixing nip part N having a predetermined width.

The pressure roller 7 is rotatively driven in the direction of arrow by a driving system M. The film 1*c* is driven thereby to rotate in the direction of arrow around the coil assembly 2 (a pressure roller driving system). An alternating current is applied to the excitation coil 3, whereby the electrically conductive member 1*b* is caused to electromagnetically induction-heat. The temperature state of the electrically conductive member 1*b* (the temperature of the fixing nip part N) is detected by a thermistor 8 as a temperature detecting element, and the detected temperature information is inputted to a control circuit 10. The control circuit 10 controls the application of the alternating current from an excitation circuit 9 to the excitation coil 3 so that the temperature of the fixing nip part N may be controlled and maintained at a predetermined fixing temperature.

As previously described, the recording material P to which the unfixed toner image t has been transferred in the transferring nip part is introduced to the fixing nip part N and is nipped and conveyed thereby, and in the process of being nipped and conveyed, the unfixed toner image t is heated and fixed on the surface of the recording material P by the heat and nip pressure of the electromagnetically induction-heated electrically conductive member 1*b* through the film 1*c*.

4) The heating apparatus of the present invention is not restricted to the image heating and fixing apparatus of the embodiment, but can be widely used as an image heating apparatus for heating a recording material bearing an image thereon to thereby improve the surface property thereof such as luster, an image heating apparatus for tentatively fixing an image, or an apparatus for heating and processing a material to be heated, such as a heating and drying apparatus for a material to be heated or a heating laminate apparatus.

Although the invention has been described in the above preferred embodiments, various changes and modifications may be made without departing from the spirit of the present invention.

What is claimed is:

1. An image heating apparatus for heating an image formed on a recording material, comprising:

an excitation coil for generating a magnetic field by being energized;

a heating member for dissipating heat by an eddy current induced in the heating member by the magnetic field;

a core for guiding the magnetic field, said core including a sheet-shaped multi-layered magnetic member; and a holder made of resin, for holding said core and said excitation coil, wherein said holder includes a cramping portion for cramping said core with an elastic force.

2. An image heating apparatus according to claim 1, wherein said sheet-shaped multi-layered magnetic member is an amorphous alloy.

3. An image heating apparatus according to claim 1, wherein said sheet-shaped multi-layered magnetic member is a silicon steel sheet.

4. An image heating apparatus according to claim 1, wherein said sheet-shaped multi-layered magnetic member is made integral by an adhesive agent.

5. An image heating apparatus according to claim 1, wherein said holder holds said core so that a plane of said sheet-shaped magnetic member is perpendicular to said heating member.

6. An image heating apparatus according to claim 1, wherein a thickness of said sheet-shaped magnetic member is 10 $\mu$m to 300 $\mu$m.

7. An image heating apparatus according to claim 1, wherein said heating member is of a shape of a rotary member having said coil and said core therein.

8. An image heating apparatus according to claim 1, further comprising a second holder for holding said core, wherein said second holder holds said core in cooperation with said holder.

9. An image heating apparatus according to claim 8, wherein said second holder includes a second cramping portion for cramping said core.

* * * * *

UNITED STATES PATENT AND TRADEMARK OFFICE

CERTIFICATE OF CORRECTION

PATENT NO. : 6,713,734 B2
DATED : March 30, 2004
INVENTOR(S) : Hitoshi Suzuki

It is certified that error appears in the above-identified patent and that said Letters Patent is hereby corrected as shown below:

Column 8,
Line 34, "As previous" should read -- As previously --.

Signed and Sealed this

Twentieth Day of July, 2004

JON W. DUDAS
*Acting Director of the United States Patent and Trademark Office*